US005753874A

United States Patent [19]

Kossakowski

[11] Patent Number: 5,753,874

[45] Date of Patent: May 19, 1998

[54] ROCKER MEMBER ACTUATED SWITCH ASSEMBLY

[75] Inventor: Thomas Kossakowski, Ludenscheid, Germany

[73] Assignee: Leopold Kostal GmbH & Co. KG, Germany

[21] Appl. No.: 762,399

[22] Filed: Dec. 9, 1996

[30] Foreign Application Priority Data

Jan. 10, 1996 [DE] Germany ..... 196 00 657.0

[51] Int. Cl.[6] ..... H01H 9/00; H01H 9/26; H01H 21/24

[52] U.S. Cl. ..... 200/1 B; 200/5 A; 200/277.2; 200/557

[58] Field of Search ..... 200/1 B, 5 A, 200/5 R, 275–277.2, 339, 512–517, 557, 553

[56] References Cited

U.S. PATENT DOCUMENTS

| | | | |
|---|---|---|---|
| 5,412,164 | 5/1995 | Conway et al. | 200/1 B |
| 5,430,261 | 7/1995 | Malone | 200/1 B |
| 5,510,583 | 4/1996 | Pescetto | 200/1 B |
| 5,559,311 | 9/1996 | Gorbatoff | 200/513 |

FOREIGN PATENT DOCUMENTS 41 04 572 C2 9/1993 Germany .

*Primary Examiner*—Michael L. Gellner
*Assistant Examiner*—Michael J. Hayes
*Attorney, Agent, or Firm*—Brooks & Kushman P.C.

[57] ABSTRACT

A multi-stage electrical rocker actuated switch assembly is disclosed which basically consists of a rocker operating element which is pivotably mounted on a housing and four plungers which face the underside of the rocker operating element with one of their ends while the other ends engage with a movable contact part. In order to create a multi-stage rocker actuated switch in which two exactly definable functional positions in each direction can clearly be felt by the user because of a sharp change in the operating forces during operation of the rocker operating element, the two movable contact parts present in each functional group are so different in design that in order to switch over the one movable contact part, a force is necessary whose magnitude is definable different from the force which is necessary to switch over the other movable contact part and wherein for each functional group an intermediate element in the form of a two-armed lever is present which is situated between the ends of the two plungers belonging to each functional group and the underside of the rocker operating element, both intermediate elements being capable of displacement in the operational direction of the rocker operating element while at the same time they are mounted to as to be capable of tilting crosswise relative to the operational direction of the rocker operating element.

12 Claims, 4 Drawing Sheets

ROCKER MEMBER ACTUATED SWITCH ASSEMBLY

TECHNICAL FIELD

The present invention is based on a multi-stage electrical rocker activated switch assemblies.

BACKGROUND ART

This type of switch generally fulfills the purpose of switching electrical circuits on and off or switching over from one electrical circuit to another. In these electrical rocker activated switches, many types of different contact systems can be used. The electrical rocker activated switches are operated by a pivotal action of a rocker operating element, which can be brought into two functional positions in each direction - four functional positions in total. The different functional positions can be designed with detect and/or touch contact operation.

A multi-stage electrical rocker activated switch assembly of the type described in the preamble of the main claim has become known in the art through DE 41 04 572C2. In one embodiment of the invention described in this document, the transfer system, which is pretensioned and situated between the underside of the operating element and the movable contact parts, consists of four individually-adjustable plungers which are arranged in two groups of two plungers each, one group being allocated to each operating direction. In order to achieve two different switching positions in each operating direction, the two movable contact parts belonging to each functional group exhibit different lengths of switch travel. In order to compensate for this during operation of the operating element, the movable contact part with the shorter contact travel is provided with a plunger in the form of a spring package. Operation of the operating element in either direction therefore first causes the movable contact part with the shorter travel to engage with its corresponding fixed contact parts. By means of further operation of the operating element, the movable contact part with the longer travel then engages with its fixed contact parts, while at the same time the helical spring in the spring package is compressed to a greater and greater extent. Because of the helical spring, however, the operating forces increase continuously during operation of the switch, which causes a spongy switch feel. This means that it is not always possible to differentiate exactly between the two functional positions in each operating direction.

SUMMARY OF THE INVENTION

The aim of the present invention is to create a multi-stage rocker activated electrical switch assembly of the type mentioned at the beginning of this description in which a sudden change in the operating force during operation of the operating element makes two exactly definable functional positions clearly recognizable to the user in each operating direction.

This aim is fulfilled by means of the features described in the characterizing section of the main claim. A particular advantage of a multi-stage electrical rocker activated switch designed in such a way is that two exactly definable functional positions can be achieved in each operating direction even when different contact systems are used.

Further advantageous features are described in the subclaims and explained in more detail by means of two embodiments which are shown in the drawings.

BEST MODE(S) FOR CARRYING OUT THE INVENTION

Figure 1:
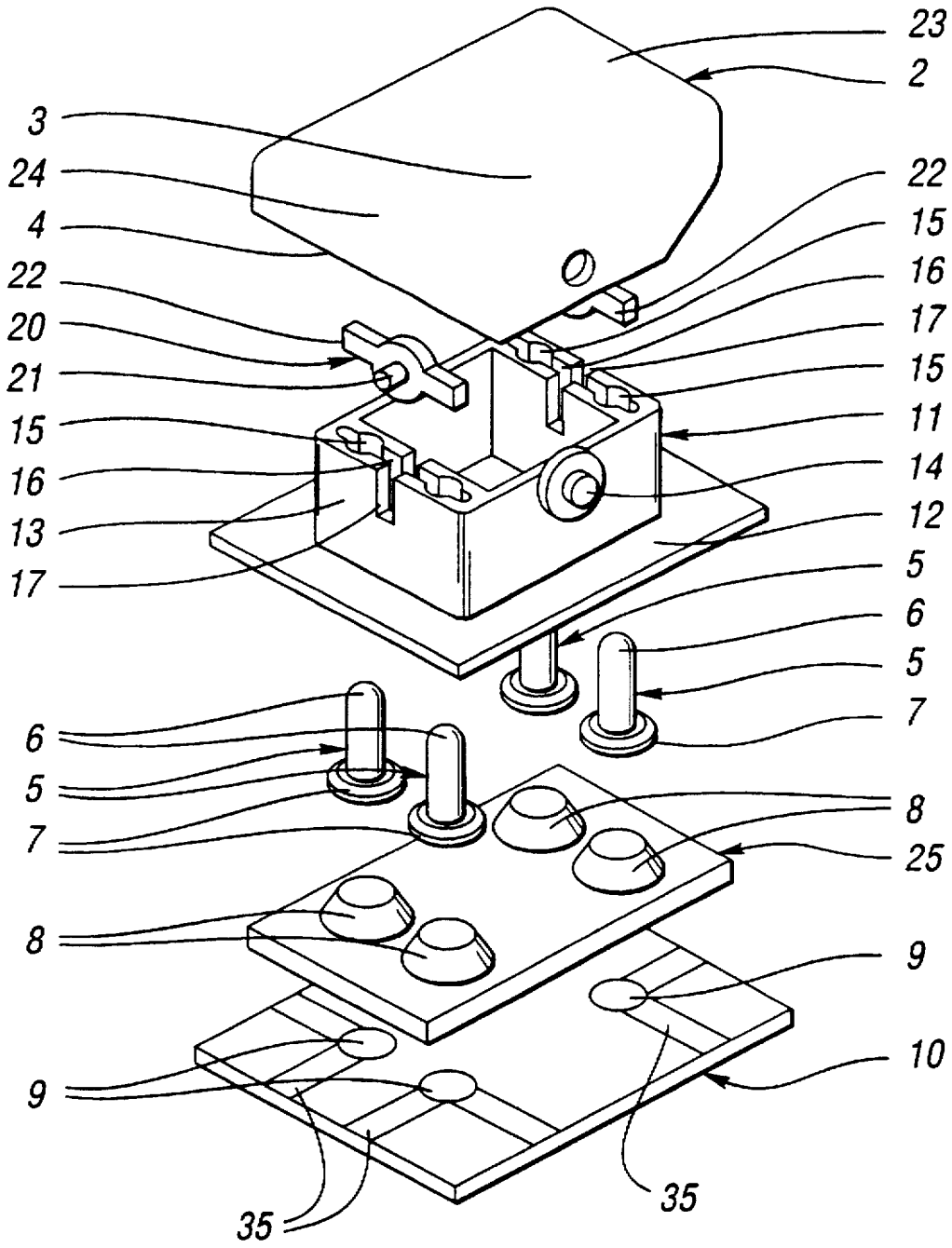
FIG. 1 is an exploded view of a multi-stage electrical rocker activated switch showing essential principles.
Figure 2:
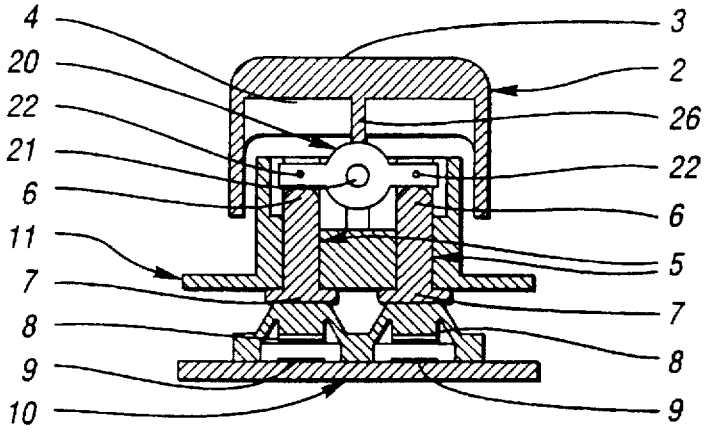
FIG. 2 is a cross-sectional view of the electrical rocker switch shown in FIG. 1 in the neutral position.

As can be seen from the drawings, such a multi-stage electrical rocker activated switch assembly essentially consists of an rocker operating element 2 pivotably mounted in housing 1, which can be pivoted in two directions starting from a neutral position, whereby the lower side 4 facing away from operating surface 3 stands in relation to four plungers 5 which are movably mounted in housing 1 (FIGS. 5-8). Plungers 5, each of whose ends 6 face the underside 4 of rocker operating element 2, each come to rest against a movable contact part 8 at their other ends 7. In order to fulfill different switching functions, movable contact parts 8 such as snap switching discs in their turn engage with fixed contact parts 9 which are in the form of conductive track formations 35 of a printed circuit board 10 located in housing 1.

As also can be seen from the drawings, four plungers 5 are arranged in pairs to form two functional groups, so that two functional groups each provided with two plungers 5 are formed. Two plungers 5 of a functional group are allocated to each operational direction of rocker operating element 2. In other words, two plungers 5 are located at one end area 23 of rocker operating element 2 away from the pivotal axis and two plungers 5 are located at the other end area 24 of rocker operating element 2 away from the pivotal axis. However, underside 4 of rocker operating element 2 does not come directly into functional relationship with the four plungers 5, but rather this relationship is achieved by means of two intermediate elements 20. One intermediate element 20 is therefore allocated to each group of two plungers 5 belonging to each functional group. In order that plungers 5 may be operated in a controlled fashion, intermediate elements 20 are each in the form of a twoarmed lever. A formed-on tilt axis divides each of the two intermediate elements 20 in such a way that two arms of identical length result. The tilt axis is created in each case by two axis stumps 21 which are formed onto the two main surfaces of intermediate element 20 at a central point.

In order to operate the two plungers 5 belonging to a group, each intermediate element 20 comes to rest against the top surface of a plunger 5 with the edge surface facing away from the underside 4 of rocker operating element 2 of one of its two arms 22 . In order to ensure safe longitudinal guiding of plungers 5, housing 1, which is only shown in the second embodiments includes a guide plate 11 which is provided with four guide slots 15. Each guide slot 15 receives one of the four plungers 5 so that the plungers 5 can be slid in a longitudinal direction. The guide slots 15 are also present in guide plate 11, arranged in functional groups.

Each of the four plungers 5 comes to rest with it other end 7 directly against one of the four movable contact parts 8 of the rocker operating switch, with movable contact parts 8 being designed as thrust pieces and forming elements within a so-called flexible dome switching mat. Two plungers 5 are allocated to two movable contact parts 8 within the functional groups. The other ends 7 of the four plungers 5 come to rest against the movable contact parts 8 under light pre-tension to ensure that the rocker actuated switch assembly is free of rattle. Each of the two movable contact parts 8 belonging to a functional group exhibit very different magnitude of operating forces. Each functional group is provided with one movable contact part 8 with a high operating force and one movable contact part 8 with a low operating force. The operating force needed to operate one of the two movable contact 8 is in fact approximately double that needed to operate the other of the two movable contact parts 8. Methods which are suitable for achieving operating forces of different magnitudes are, for example, defined weakening of the material in certain areas of one of the movable contact parts 8.

As can particularly be seen from FIGS. 1 to 4, the guide plate 11 in use there essentially consists of a retaining collar 12 running parallel to printed circuit board 10 and a basically rectangular carrier frame 13 formed onto it in the manner of a flange. A pivot 14 is formed onto the outside surfaces of both long sides of carrier frame 13 to form a bearing for rocker operating element 2. Both pivots 14 are formed onto the edge area of carrier frame 13 which faces towards rocker operating element 2 and are located opposite to one another. They are in the form of stump-like extensions. Two guide slots 15 with a round cross-section are formed inside both narrow sides of carrier frame 13 and these each receive one of the four plungers 5 which each also exhibit a round cross-section in such a way that the plungers 5 can be slid longitudinally. By means of this arrangement two plungers 5 are allocated to one narrow side of guide plate 11 and two plungers 5 are allocated to the other narrow side of guide plate 11, each two plungers 5 forming a functional group. The upper areas facing rocker operating element 2 of the two guide slots 15 present in each narrow side are connected with each other by means of a retaining pocket 16 in such a way that a canal is formed. The two retaining pockets 16 are each intended to receive one of the two intermediate elements 20 and their width is less than the cross-sections of the guide slots 15 which they connect. This results in a dumbbell-shaped cross-section or both retaining pockets 16. Positioned centrally between the two guide slots 15 provided in each narrow side of carrier frame 13, there is a guide slit 17 which penetrates the frame 13. The guide slit 17 of each retaining pocket 16 runs parallel to the direction of extension of guide slots 15 and each receives one of the axis stumps 21 of the relevant intermediate element 20 in such a way as to guide it. The length of the two guide slits 17 is adjusted to the operational travel of rocker operating element 2 so that intermediate elements 20 are moved with the operation of rocker operating element 2 in accordance with the actual direction of operation. In order to achieve this movement, an operating extension 26 formed onto the underside 4 of rocker operating element 2 comes to rest against the central area of each intermediate element 20. By means of guide slits 17 and the form of the two retaining pockets 16, each intermediate element 20 is moved longitudinally in a linear fashion in accordance with the movement of plungers 5 and at the same time because of the different magnitudes of the operating forces of the two movable contact parts 8 allocated to an intermediate element 20 is turned about its tilt axis.

Figure 3:
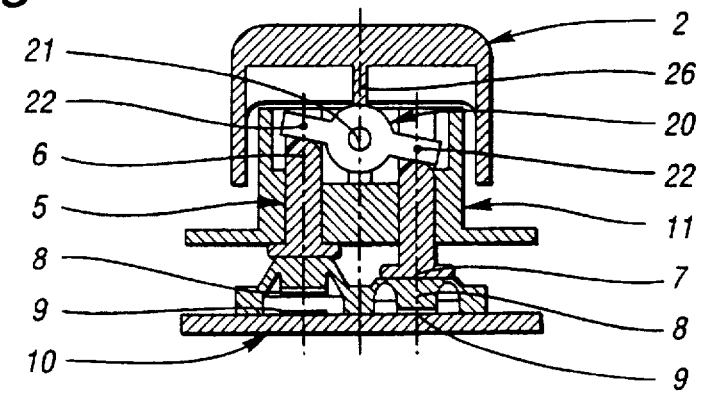
FIG. 3 is a cross-sectional view of the electrical rocker activated switch shown in FIG. 1 in its first functional position in one operation direction.

As can particularly be seen in FIG. 3, intermediate element 20 is turned because when rocker operating element 2 is operated in one or the other of its operational directions, at first only the plunger 5 is moved which is allocated to the movable contact part 8 with the low operating force. Only when this movable contact part 8 has engaged with its fixed contact parts 9 and the electrical rocker activated switch assembly therefore has taken up its first functional position in relation to one operational direction, is it possible, by means of further operation of rocker operating element 2, to move the plunger 5 which is allocated to the movable contact part 8 with the higher operating force.

Figure 4:
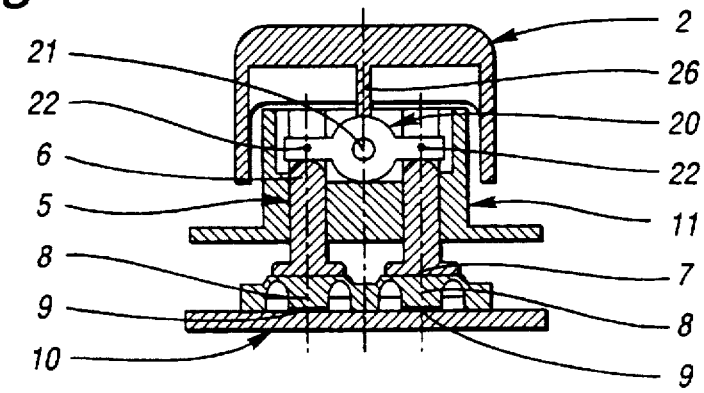
FIG. 4 is a cross-sectional view of the electrical rocker activated switch shown in FIG. 1 in its second functional position in one operation direction.
Figure 5:
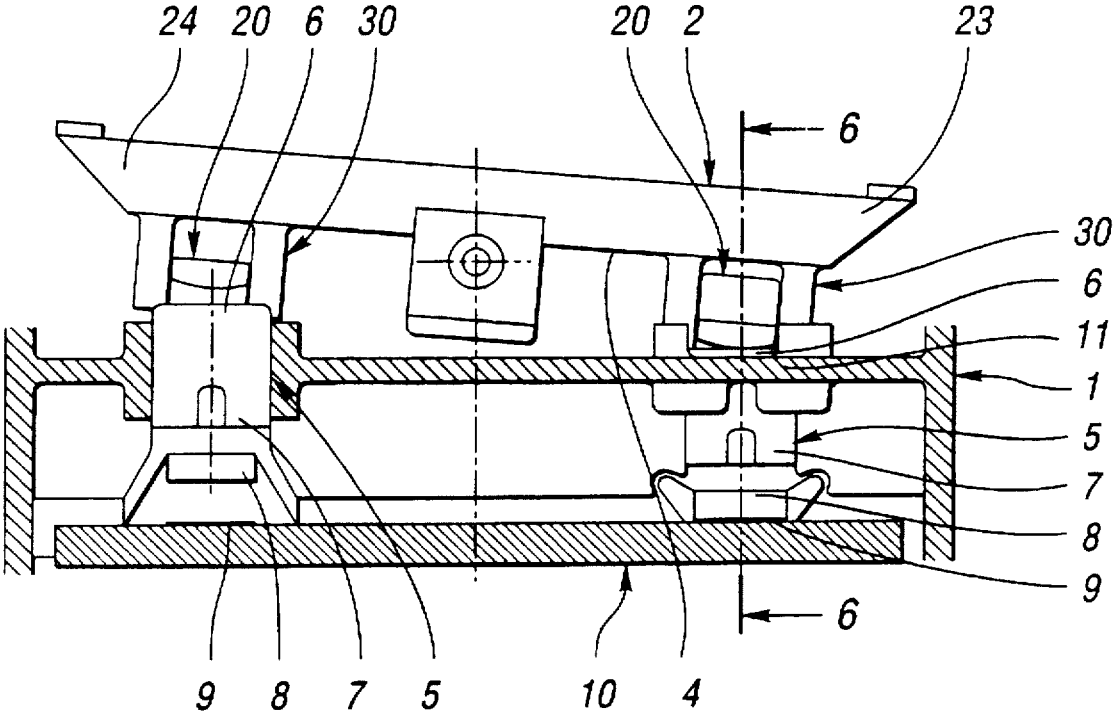
FIG. 5 is a side view of a second embodiment of an electrical rocker activated switch in its first functional position in one operating direction showing essential principles.

As can particularly be seen from FIG. 4, intermediate element 20 turns again into its initial position when rocker operating element 2 is operated further. When the second functional position of the actuated rocker switch assembly with regard to one operation direction is reached, intermediate element 20 finally returns to its initial position and the movable contact part 8 with the higher operating force is also engaged with its fixed contact parts 9 so as to provide electrical contact.

As a considerable difference (approximately double) exists in the operating forces which are necessary for the two movable contact parts 8 belonging to a functional group, the user clearly feels an exact pressure point. Because of the way the operating forces of the four movable contact parts 8 are tuned within the functional groups, a pressure point with a snap-type effect results when rocker operating element 2 is operated, namely, starting from its neutral position, in one operational direction in the first functional position and in both operational directions in the second functional position.

As can particularly be seen in FIGS. 5 to 8, the guide plate 11 used there forms an integral part of housing 1 and essentially extends parallel to the printed circuit board 10 which is held in housing 1. In this embodiment of rocker operating element 2, mounted on housing 1 in a pivotable manner, only the illumination reflector portion which is provided with the necessary bearing points is shown. Four guide slots 15 with cross-shaped cross-sections are formed into guide plate 11, each of which receives one of the four plungers 5, which also exhibit cross-shaped cross-sections, in such a way that the plungers 5 can be longitudinally displaced. The four guide slots 15 are arranged in such a way that the two plungers 5 of the one and the two plungers 5 of the other functional group are each allocated to a narrow side of guide plate 11. In order that both intermediate elements 20 may be tilted, a bearing arrangement 30 is formed onto the two end areas 23,24 of rocker operating element 2 away from the pivotal axis. Because of this, both intermediate elements 20 which are allocated to the underside 4 of rocker operating element 2 are automatically displaced with operation of rocker operating element 2. By means of the tilt-type bearing on the underside of rocker operating element 2, each intermediate element 20 exhibits bow-shaped displacement corresponding to the operation motion of rocker operating element 2, and at the same time, because of the difference in the operating forces of the two movable contact parts 8 which are allocated to each intermediate element 20, intermediate element 20 also turns about its tilt axis.

Figure 6:
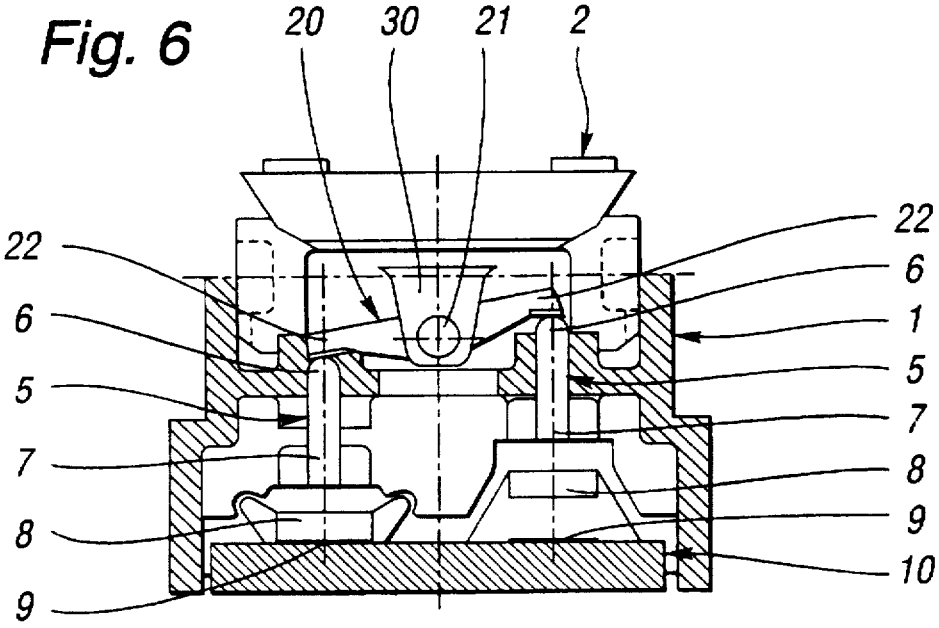
FIG. 6 is a section of the electrical rocker activated switch shown in FIG. 5 along line 6—6.
Figure 7:
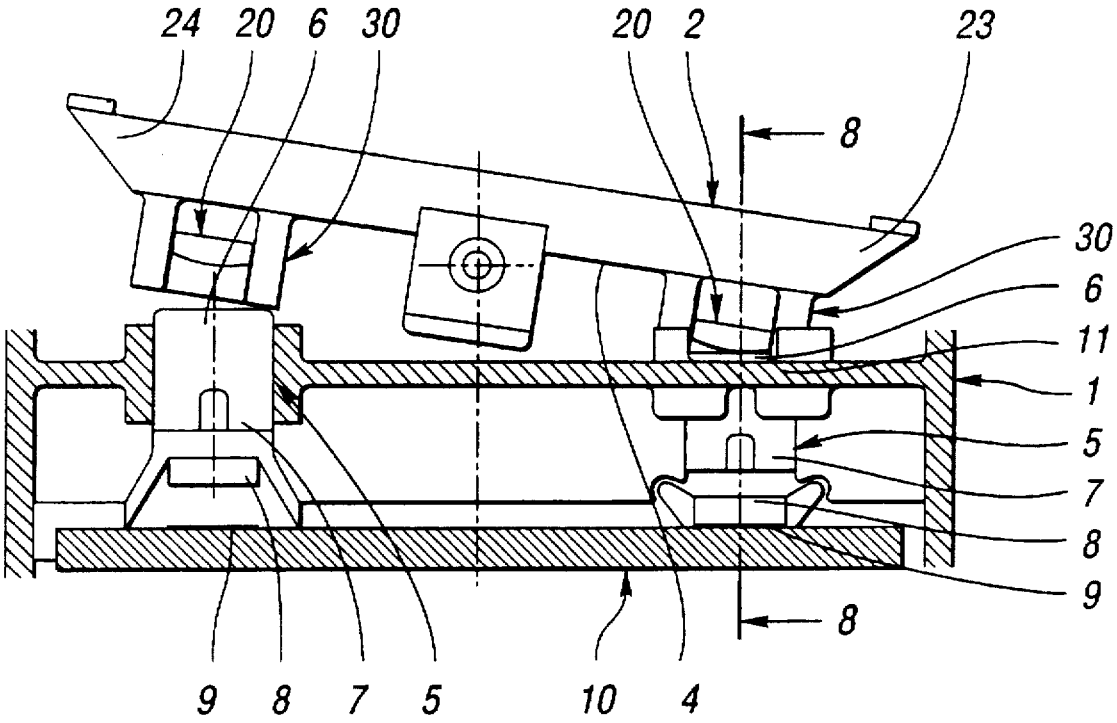
FIG. 7 is the electrical rocker activated switch shown in FIG. 5 in its second functional position in one operating direction.

As can be particularly seen from FIG. 6, intermediate element 20 is turned because, with operation of rocker operating element 2 in one or the other operational directions, first only the plunger 5 is displaced which is allocated to the movable contact part 8 with the low operating force. Only when this movable contact part 8 has engaged with its fixed contact parts 9 and the electrical rocker actuated switch assembly therefore has taken up its first functional position with regard to one operational direction, is it possible by means of further operation of rocker operating element 2 to displace the plunger 5 which is allocated to the movable contact part 8 with the higher operating force.

Figure 8:
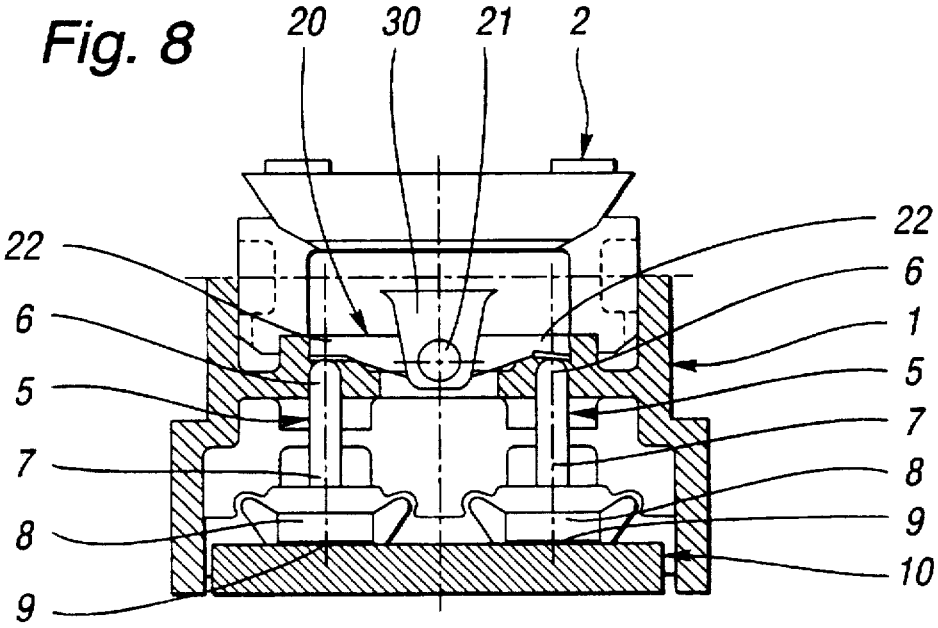
FIG. 8 is a section of the electrical rocker activated switch shown in FIG. 7 along line 8—8.

As can particularly be seen from FIG. 8, intermediate element 20 turns back into its initial position when rocker operating element 2 is operated further. When the second functional position of the rocker operating element 2 with regard to one operational direction is reached, intermediate element 20 finally returns to its initial position and the movable contact part 8 exhibiting the higher operating force is now likewise engaged with its fixed contact parts 9 so as to provide electrical contact.

As a considerable difference (approximately double) exists in the operating forces which are necessary for the two movable contact parts 8 belonging to a functional group, the user clearly feels an exact pressure point. Because of the way the operating forces of the four movable contact parts 8 are tuned within the functional groups, a pressure point with a snap-type effect results when rocker operating element 2 is operated, namely, starting from its neutral position, in one direction in the first functional position and in both directions in the second functional position.

What is claimed is:

1. A multi-stage electrical rocker actuated switch assembly for motor vehicles with a housing which accommodates fixed and movable contact parts, with at least one rocker operating element mounted on the housing which, starting from a neutral position can be brought into four functional positions through its two operating directions, whereby the underside of the rocker operating element cooperates with one end of each of four plungers which are mounted in the housing so as to be slidable and which each can be displaced separately from the others, the other ends of the plungers engaging with four movable contact parts, whereby for each operating direction, two movable contact parts and two plungers are gathered into one functional group in such a way that by operation of the rocker operating element in one of its two operating directions, after a first operational travel one of the two movable contact parts and after a second operational travel, both movable contact parts of a functional group engages or engage with the associated fixed contact parts so as to give electrical contact, wherein:

both movable contact parts which are present in each functional group exhibit different designs so that in relation to the relevant functional group, a force is needed to switch over one movable contact part which is different in magnitude from the force which is needed to switch over the other movable contact part; and for each functional group, an intermediate element in the form of a two-armed lever situated between the ends of the two plungers belonging to a functional group and the underside of the rocker operating element, whereby the two intermediate elements can each be displaced in the operating direction of the rocker operating element and are mounted so as to be capable of tilting crosswise to the operating direction.

2. A multi-stage electrical rocker actuated switch assembly according to claim 1, wherein:

a tilt axis of the intermediate elements is in each case in the form of an axis stump which is formed onto the intermediate elements.

3. A multi-stage electrical rocker actuated switch assembly according to claim 1, wherein:

a tilt axis of at least one of the two intermediate elements is arranged in such a way that two arms of the same length are formed.

4. A multi-stage electrical rocker actuated switch assembly according to claim 1, wherein:

four guide slots which are present in the housing and which each accommodate one plunger so that the plunger can be slidably displaced are arranged in such a way that two plungers belonging to one functional group are allocated to one end area of the rocker operating element away from a pivotal axis; and two plungers belonging to the other functional group are allocated to another end area of the rocker operating element.

5. A multi-stage electrical rocker actuated switch assembly according to claim 1, wherein:

a bearing arrangement located on the underside of the rocker operating element away from a pivotal axis is formed on to accept one of the two intermediate elements in a tiltable fashion; and each intermediate element comes to rest against the top surfaces of both plungers allocated to it with edge surfaces of both its arms which face away from the underside in order to operate the two plungers allocated to it.

6. A multi-stage electrical rocker actuated switch assembly according to claim 4, wherein:

the upper areas of both guide slots belonging to each functional group which face the rocker operating element are connected with each other by a retaining pocket, whereby each retaining pocket accommodates one of the two intermediate elements and is arranged to turn crosswise to the direction in which the two guide slots run.

7. A multi-stage electrical rocker actuated switch assembly according to claim 6, wherein:

the two retaining pockets are narrower across their width than the cross-sections of the two guide slots allocated to each, so that each of the two retaining pockets exhibits a dumbbell-like cross-section.

8. A multi-stage electrical rocker actuated switch assembly according to claim 4, wherein:

at least one guide slit is centrally placed between the two guide slots belonging to a functional group and running parallel to them with which a tilt axis of the associated intermediate element engages.

9. A multi-stage electrical rocker actuated switch assembly according to claim 1, wherein:

an operating extension is formed onto the underside of the rocker operating element away from a pivotal axis which comes to rest against an edge surface facing the underside of a central area of the intermediate element allocated to it; and each intermediate element, in order to operate the two plungers allocated to it, coming to rest against the plungers with the edge surfaces of its two arms which face away from the underside.

10. A multi-stage electrical rocker actuated switch assembly according to claim 1, wherein:

the housing contains a guide plate in which guide slits and retaining pockets and on which a bearing arrangement for swiveling action of the rocker operating element are present in an integral form.

11. A multi-stage electrical rocker actuated switch assembly according to claim 1, wherein:

the fixed contact parts are in the form of conductive track formations of an electrical printed circuit board; and the movable contact parts are pressure elements of a so-called flexible dome switching mat.

12. A multi-stage electrical rocker actuated switch assembly according to claim 1, wherein:

the fixed contact parts are in the form of conductive track formations of an electrical printed circuit board; and the movable contact parts are in the form of so-called snap switching discs.

* * * * *